US010636590B2

(12) United States Patent
Iyadomi

(10) Patent No.: US 10,636,590 B2
(45) Date of Patent: Apr. 28, 2020

(54) WATERPROOF SWITCH DEVICE

(71) Applicant: Olympus Corporation, Hachioji-shi, Tokyo (JP)

(72) Inventor: Takayoshi Iyadomi, Hachioji (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 16/219,353

(22) Filed: Dec. 13, 2018

(65) Prior Publication Data

US 2019/0198266 A1 Jun. 27, 2019

(30) Foreign Application Priority Data

Dec. 25, 2017 (JP) ..... 2017-247819

(51) Int. Cl.

| | |
|---|---|
| ***H01H 9/04*** | (2006.01) |
| ***H01H 19/06*** | (2006.01) |
| ***H01H 13/06*** | (2006.01) |
| ***H01H 15/06*** | (2006.01) |

(52) U.S. Cl.

CPC ..... *H01H 9/04* (2013.01); *H01H 13/06* (2013.01); *H01H 15/06* (2013.01); *H01H 19/06* (2013.01); *H01H 2223/002* (2013.01)

(58) Field of Classification Search

CPC ..... H01H 9/04; H01H 15/06; H01H 13/06; H01H 19/06; H01H 2223/002

USPC ..... 200/302.1–302.3

See application file for complete search history.

(56) References Cited

U.S. PATENT DOCUMENTS 4,596,912 A * 6/1986 Hattori ..... H01H 13/52 200/302.2

FOREIGN PATENT DOCUMENTS

JP 07-211187 A 8/1995

* cited by examiner

*Primary Examiner* — Edwin A. Leon
*Assistant Examiner* — Lheiren Mae A Caroc
(74) *Attorney, Agent, or Firm* — John C. Pokotylo; Pokotylo Patent Services

(57) ABSTRACT

A waterproof switch device includes: a switch member including a body portion and a movable portion; an operated portion that is a shaft member having a distal end exposed from an opening provided in an exterior member of an electronic apparatus and a proximal end connected to the movable portion, the operated portion including a flange portion extending in a radial direction; a waterproof cover made of elastomer material; and a retaining member including an opening portion through which a part of the operated portion closer to the distal end than the flange portion can pass but the flange portion cannot pass, the retaining member being disposed farther inward from the exterior member than the waterproof cover.

4 Claims, 4 Drawing Sheets

WATERPROOF SWITCH DEVICE

CROSS REFERENCE TO RELATED APPLICATION

This application claims the benefit of Japanese Application No. 2017-247819 filed in Japan on Dec. 25, 2017, the contents of which are incorporated herein by this reference.

BACKGROUND OF THE INVENTION

Field of the Invention

The present invention relates to a waterproof switch device including a movable portion, which is provided in an electronic apparatus.

Description of the Related Art

A switch provided on an electronic apparatus to be operated is provided with an operated portion that is exposed from an opening provided on an exterior member of the electronic apparatus, for example, as described in Japanese Patent Application Laid-Open Publication No. 7-211187. A user of the electronic apparatus operates the switch by applying pushing-in or pushing-down force to the operated portion.

BRIEF SUMMARY OF THE INVENTION

A waterproof switch device according to an aspect of the present invention is a waterproof switch device provided in an electronic apparatus, the waterproof switch device including: a switch member including a body portion and a movable portion configured to move relative to the body portion, the body portion being fixed to an inner side of an exterior member of the electronic apparatus, and the switch member being configured to exert electrical action according to movement of the movable portion; an operated portion that is a shaft member having a distal end exposed from an opening provided in the exterior member and a proximal end connected to the movable portion, the operated portion including a flange portion extending in a diameter direction between the distal end and the proximal end; a waterproof cover made of elastomer material, the waterproof cover including a first watertight portion in which a through hole is formed, the first watertight portion being in tight contact with an outer circumferential surface of a part of the operated portion between the distal end and the flange portion, a second watertight portion that is in tight contact with an internal surface of the exterior member in a manner of surrounding the opening or in tight contact with a whole inner circumferential surface of the opening in a circumferential direction, and a film-like portion provided between the first watertight portion and the second watertight portion; and a retaining member including an opening portion through which a part of the operated portion closer to the distal end than the flange portion can pass but the flange portion cannot pass, the retaining member being disposed farther from the exterior member inward than the waterproof cover.

DETAILED DESCRIPTION OF THE PREFERRED EMBODIMENT

Figure 1:
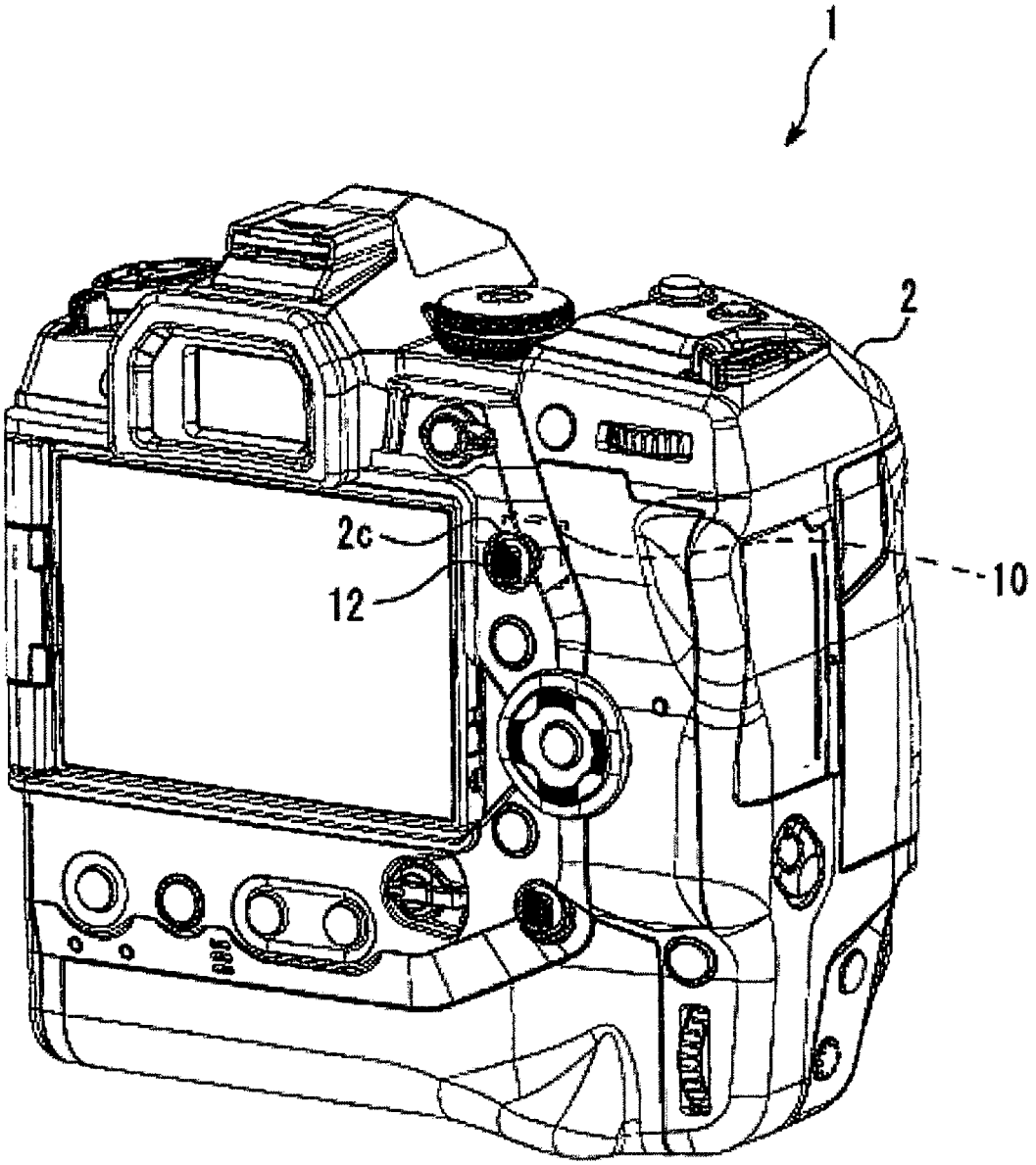
FIG. 1 is a perspective view showing an external appearance of an electronic apparatus provided with a waterproof switch device.

A preferred embodiment of the present invention will be described below with reference to drawings. Note that, on each of drawings used in the description below, a reduced scale of each component is made different so that the component is in a size recognizable on the drawing, and the present invention is not limited only to the number of components, shapes of the components, a size ratio among the components, and a relative positional relationship among the respective components illustrated on the drawings.

An example of the embodiment of the present invention will be described below. A waterproof switch device 10 of the present embodiment is disposed on an electronic apparatus 1 as shown in FIG. 1. In the present embodiment, the electronic apparatus 1 is an image pickup apparatus as an example.

The waterproof switch device 10 is provided with an operated portion 12 exposed on an outer surface of an exterior member 2 of the electronic apparatus 1. The operated portion 12 is movable relative to the exterior member 2. The waterproof switch device 10 is electrically connected to an electrical circuit provided in the electronic apparatus 1 and exerts electrical action on the electrical circuit according to movement of the operated portion 12. Here, the electrical action may be, for example, switching between presence and absence of electrical conduction among a plurality of conductors in the electrical circuit or may be, for example, a change in a value of an electrical resistance among the plurality of conductors in the electrical circuit. The waterproof switch device 10 is a device for a user of the electronic apparatus 1 to input an operation instruction to the electronic apparatus 1 by applying force to the operated portion 12 by hand, for example.

In the present embodiment, the waterproof switch device 10 is provided with the operated portion 12 that is in a lever shape, as an example. The lever-shaped operated portion 12 is located at a neutral position when external force is not applied. The operated portion 12 is tilted in one or more directions from the neutral position.

In the present embodiment, the waterproof switch device 10 accepts eight types of input operations of tilting the lever-shaped operated portion 12 in eight directions from the neutral position and one type of input operation of pushing in the operated portion 12 toward an inner side of the electronic apparatus 1. Note that the eight directions in which the operated portion 12 is tilted from the neutral position are arranged at equal intervals of 45 degrees in a circumferential direction.

The waterproof switch device 10 provided on the electronic apparatus 1, which is an image pickup apparatus, is used, for an input operation of specifying a focus position in an autofocus operation, an input operation of movement of and selection from a menu in GUI, and the like.

Figure 2:
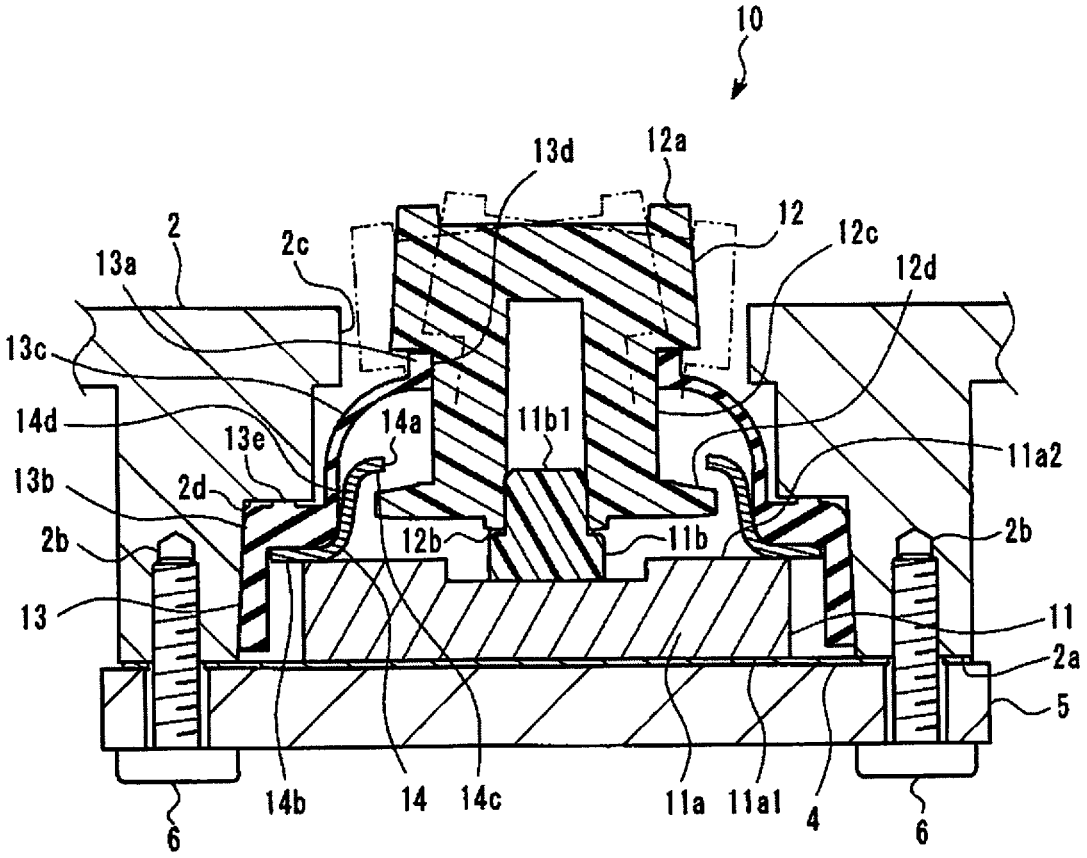
FIG. 2 is a cross-sectional view of the waterproof switch device.
Figure 3:
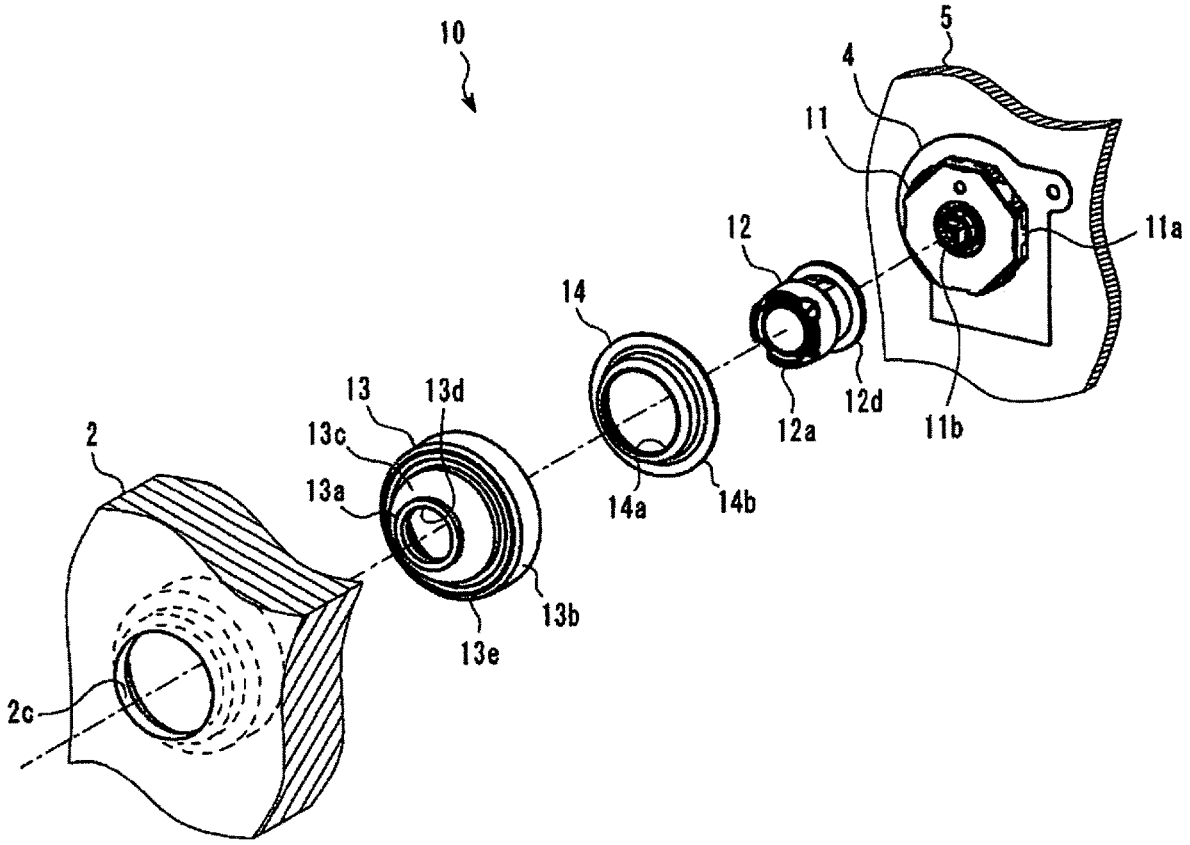
FIG. 3 is an exploded perspective view of the waterproof switch device.

Next, details of a configuration of the waterproof switch device 10 of the present embodiment will be described. FIG. 2 is a cross-sectional view of the waterproof switch device 10. FIG. 3 is an exploded perspective view of the waterproof switch device 10.

The waterproof switch device 10 is provided with a switch member 11, the operated portion 12, a waterproof cover 13, and a retaining member 14.

The switch member 11 includes a body portion 11*a* and a movable portion 11*b*. The movable portion 11*b* is a member configured to move relative to the body portion 11*a*. The switch member 11 is an electronic part configured to exert electrical action corresponding to movement of the movable portion 11*b* relative to the body portion 11*a*.

The movable portion 11*b* is provided with a columnar portion 11*b*1 projecting from the body portion 11*a*. The operated portion 12 to be described later is combined with the columnar portion 11*b*1. As described before, the movable portion 11*b* of the switch member 11 of the present embodiment can perform the movement of tilt in the eight directions from the neutral position and the movement in the direction of being pushed in toward the body portion 11*a* from the neutral position.

The body portion 11*a* is implemented on an electronic circuit board 4 that the electronic apparatus 1 is provided with and is electrically connected to the electrical circuit formed on the electronic circuit board 4. The switch member 11 is a so-called surface-mount-type electronic part, and a lower surface 11*a*1 faces the electronic circuit board 4. The columnar portion 11*b*1 of the movable portion 11*b* described before projects in a direction substantially orthogonal to the electronic circuit board 4 from an upper surface 11*a*2 facing an opposite side of the lower surface 11*a*1 of the body portion 11*a*.

The body portion 11*a* is fixed to an inner side of the exterior member 2 of the electronic apparatus 1. The configuration for fixing the body portion 11*a* to the exterior member 2 is not especially limited. For example, the body portion 11*a* may be in a configuration of being directly fixed to the exterior member 2 with screws screwed in the exterior member 2 or may be in a configuration of being indirectly fixed to the exterior member 2 by being fixed to the electronic circuit board 4 fixed to the exterior member 2.

In the present embodiment, the body portion 11*a* is fixed to the electronic circuit board 4 fixed to the exterior member 2, as an example. The electronic circuit board 4 is fixed to a pressing plate 5 fixed to an inner surface 2*a* of the exterior member 2. The pressing plate 5 is disposed facing the body portion 11*a* with the electronic circuit board 4 in between.

For example, as shown in FIG. 2, the pressing plate 5 is fixed to the inner side of the exterior member 2 with a plurality of screws 6 screwed in a plurality of screw holes 2*b* provided on the inner surface 2*a* of the exterior member 2. The electronic circuit board 4 may be fixed to the pressing plate 5 by being supported in a sandwiched manner between the inner surface 2*a* of the exterior member 2 and the pressing plate 5, or may be fixed to the pressing plate 5 with adhesive or double-sided adhesive tape.

The operated portion 12 is a shaft-shaped member having a distal end 12*a* exposed on an outer surface of the electronic apparatus 1 from an opening 2*c* provided on the exterior member 2 and a proximal end 12*b* connected to the movable portion 11*b* of the switch member 11. Note that the operated portion 12 may be integrally formed with the movable portion 11*b*.

In the proximal end 12*b* of the operated portion 12, a fitting hole to be fitted around the columnar portion 11*b*1 of the movable portion 11*b* is formed. In a state of being fitted to the columnar portion 11*b*1, an axial direction of the operated portion 12 is substantially parallel to an extension direction of the columnar portion 11*b*1. Here, the axial direction of the operated portion 12 refers to a direction from the proximal end 12*b* toward the distal end 12*a*.

On an outer circumference of the operated portion 12, a cylindrical surface 12*c* and a flange portion 12*d* are formed. The cylindrical surface 12*c* is such a part that a shape of a cross section formed by a plane orthogonal to the axial direction is substantially circular. Around an outer circumference of the cylindrical surface 12*c*, a waterproof cover 13 to be described later is fitted.

The flange portion 12*d* is a part that projects toward an outer side in a radial direction, with respect to the cylindrical surface 12*c* on the proximal end 12*b* side. The flange portion 12*d* projects toward the outer side in the radial direction the most in an area from the distal end 12*a* to the flange portion 12*d* of the operated portion 12.

In the present embodiment, the flange portion 12*d* is in a disc shape having a larger outer diameter than a part of the operated portion 12 any other. That is, the diameter of the flange portion 12*d* is larger than a diameter of the cylindrical surface 12*c*. Note that the shape of the flange portion 12*d* is not limited to a circle but may be a regular polygon.

The waterproof cover 13 is made of elastomer material and seals a gap between the outer circumferential surface of the operated portion 12 and the inner surface 2*a* of the exterior member 2 to prevent ingress of waterdrops and dust into the inner side of the exterior member 2 from the opening 2*c*. The elastomer material constituting the waterproof cover 13 is elastic material, such as silicone resin or rubber. The waterproof cover 13 elastically deforms so as not to prevent movement of the operated portion 12.

More specifically, the waterproof cover 13 includes a first watertight portion 13*a* in which a through hole 13*d* is formed, the first watertight portion 13*a* being in tight contact with an outer circumferential surface of a part of the operated portion 12 between the distal end 12*a* and the flange portion 12*d*, a second watertight portion 13*b* that is in tight contact with the inner surface 2*a* of the exterior member 2 or an inner circumferential surface of the opening 2*c*, and a film-like portion 13*c* provided between the first watertight portion 13*a* and the second watertight portion 13*b*.

The first watertight portion 13*a* prevents liquid drops and dust from passing through a contact part between the operated portion 12 and the waterproof cover 13. The second watertight portion 13*b* prevents liquid drops and dust from passing through a contact part between the exterior member 2 and the waterproof cover 13.

The first watertight portion 13*a* prevents liquid drops and dust from passing though the contact part between the operated portion 12 and the waterproof cover 13. The first watertight portion 13*a* is in an annular shape, where the through hole 13*d* through which the cylindrical surface 12*c* of the operated portion 12 is inserted is formed. An inner circumferential surface of the through hole 13*d* is in tight contact with the whole outer circumferential surface of the cylindrical surface 12*c* in a circumferential direction. An inner diameter of the through hole 13*d* in a state in which the operated portion 12 is not inserted in the through hole 13*d* is smaller than an outer diameter of the cylindrical surface 12*c*. That is, the first watertight portion 13*a* comes into tight contact with the cylindrical surface 12*c* by fastening the cylindrical surface 12*c* of the operated portion 12 by elastic deformation.

The second watertight portion 13*b* prevents liquid drops and dust from passing though the contact part between the exterior member 2 and the waterproof cover 13. The second watertight portion 13*b* is an annular part that is in tight contact with the inner surface 2*a* of the exterior member 2 in a manner of surrounding the opening 2*c*. Or alternatively, the second watertight portion 13*b* is an annular part that is in tight contact with the whole inner circumferential surface of the opening 2*c* in a circumferential direction.

The configuration for causing the second watertight portion 13*b* to come into tight contact with the exterior member 2 is not especially limited. For example, the second watertight portion 13*b* may be configured to be in tight contact with the exterior member 2 by adhesive applied on the inner surface 2*a* of the exterior member 2 or on the inner circumferential surface of the opening 2*c*. Further, for example, the second watertight portion 13*b* may have an outer diameter larger than an inner diameter of the opening 2*c* and be configured to come into tight contact with the exterior member 2 (the inner circumferential surface of the opening 2*c*) by elastic deformation by being fitted into the opening 2*c*.

In the present embodiment, an annular flat portion 2*d* is provided around a position where the opening 2*c* in the inner surface 2*a* of the exterior member 2 is formed, as an example. In other words, the opening 2*c* is formed in the flat portion 2*d* provided on the inner surface 2*a* of the exterior member 2. The flat portion 2*d* is generally parallel to a surface where the switch member 11 of the electronic circuit board 4 is implemented and faces the electronic circuit board 4.

On the second watertight portion 13*b*, an annular lip portion 13*e* that is in tight contact with the flat portion 2*d* in a manner of surrounding the opening 2*c* is formed. On the second watertight portion 13*b*, force pushing the annular lip portion 13*e* against the flat portion 2*d* is applied.

The configuration for generating the force pushing the annular lip portion 13*e* against the annular flat portion 2*d* is not especially limited. In the present embodiment, the pressing plate 5 fixed to the exterior member 2 pushes the annular lip portion 13*e* to the flat portion 2*d*, as an example. Between the pressing plate 5 and the second watertight portion 13*b*, other members such as the electronic circuit board 4 and the switch member 11 may be supported in a sandwiched manner.

The film-like portion 13*c* connects the first watertight portion 13*a* and the second watertight portion 13*b* and closes a gap in between. The film-like portion 13*c* allows movement of the first watertight portion 13*a* relative to the second watertight portion 13*b* fixed to the exterior member 2 by elastically deforming.

In the present embodiment, the second watertight portion 13*b* is disposed at a position nearer to the switch member 11 than to the first watertight portion 13*a*. The film-like portion 13*c* is in a substantially dome shape with the second watertight portion 13*b* as a base portion and the first watertight portion 13*a* as a top portion. Note that the film-like portion 13*c* may be in a bellows shape provided with folds.

The retaining member 14 is disposed farther inward from the exterior member 2 than the waterproof cover 13 is. The retaining member 14 includes an opening portion 14*a* through which the part of the operated portion 12 closer to the distal end 12*a* than the flange portion 12*d* is inserted but the flange portion 12*d* cannot pass.

In the present embodiment, the opening portion 14*a* is a circular through hole with an inner diameter smaller than the diameter of the flange portion 12*d*, as an example. The inner diameter of the opening portion 14*a* is larger than the outer diameter of the cylindrical surface 12*c* of the operated portion 12.

An outer circumferential portion 14*b* extending to an outer side in a radial direction from the opening portion 14*a* of the retaining member 14 is supported in a sandwiched manner between the body portion 11*a* of the switch member 11 and the second watertight portion 13*b* of the waterproof cover 13. That is, in the present embodiment, the electronic circuit board 4, the body portion 11*a*, the outer circumferential portion 14*b* and the second watertight portion 13*b* are supported in a sandwiched manner between the exterior member 2 and the pressing plate 5.

More specifically, the retaining member 14 of the present embodiment is in a substantially hat shape having a distal end portion 14*c* where the opening portion 14*a* is formed, as a top portion, and the outer circumferential portion 14*b* corresponds to a brim portion of the hat shape. The retaining member 14 is disposed so as to form a convex shape toward an outer side of the exterior member 2 and is separated from the operated portion 12 inserted in the opening portion 14*a*. The opening portion 14*a* is disposed at a position nearer to the outer side of the exterior member 2 than the flange portion 12*d*. The outer circumferential portion 14*b* is disposed at a position nearer to the inner side of the exterior member 2 than to the flange portion 12*d*.

In other words, the retaining member 14 includes a cylindrical portion 14*d* surrounding a circumference of the flange portion 12*d* of the operated portion 12, having a gap between the cylindrical portion 14*d* and the circumference, the distal end portion 14*c* provided so as to close a distal end of the cylindrical portion 14*d*, the outer circumferential portion 14*b* extending from a proximal end of the cylindrical portion 14*d* to an outer side in a radial direction, and the opening portion 14*a* that is a through hole formed in the distal end portion 14*c*.

When the movable portion 11*b* of the switch member 11 moves in a normal movement range, the retaining member 14 does not interfere with the movable portion 11*b* or the operated portion 12.

In the waterproof switch device 10 of the present embodiment having the configuration described above, when pull-out force from inside of the opening 2*c* of the exterior member 2 is applied to the operated portion 12, the flange portion 12*d* comes into contact with the retaining member 14, and the operated portion 12 is prevented from falling off from the movable portion 11*b*. Therefore, in the waterproof switch device 10 of the present embodiment, it is possible to prevent breakage in a case where the force pulling out the operated portion 12 from inside of the opening 2*c* of the exterior member 2 is applied. Further, in the present embodiment, since it is possible to prevent excessive force from being applied on the waterproof cover 13 that is in tight contact with the operated portion 12 by preventing the operated portion 12 from falling off, it is possible to prevent the waterproof cover 13 from being damaged.

Figure 4:
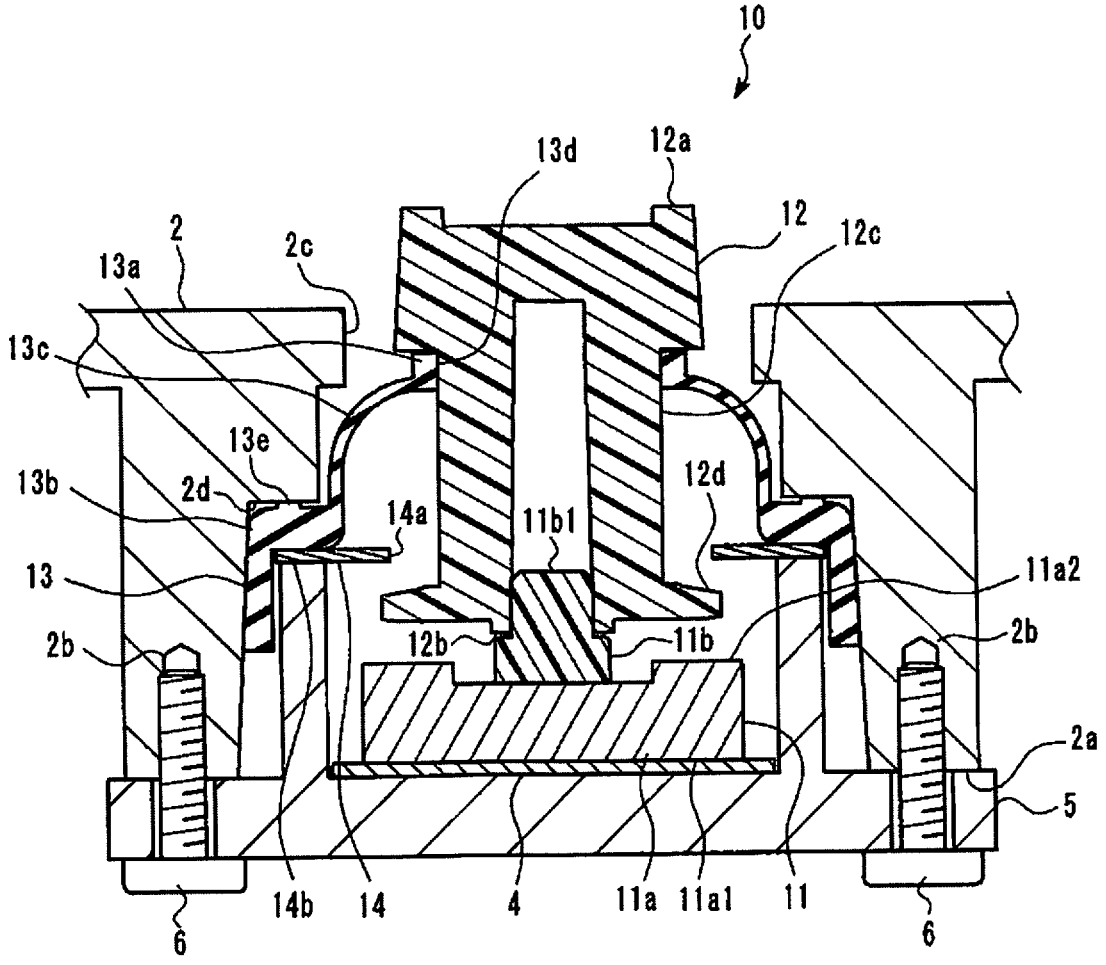
FIG. 4 is a cross-sectional view showing a modification of a retaining member.

Note that though the retaining member 14 is in a hat shape in the present embodiment described above, the retaining member 14 may be a flat board shape as shown in FIG. 4 as a modification.

The present invention is not limited to the embodiment described above but can be appropriately changed within a range not departing from the spirit or idea of the present invention that can be read from the claims and the whole specification. A waterproof switch device in which such a change has been made is also included in the technical scope of the present invention.

What is claimed is:

1. A waterproof switch device provided in an electronic apparatus, the waterproof switch device comprising:

a switch member including a body portion and a movable portion configured to move relative to the body portion, the body portion being fixed to an inner side of an exterior member of the electronic apparatus, and the switch member being configured to exert electrical action according to movement of the movable portion;

an operated portion that is a shaft member having a distal end exposed from an opening provided in the exterior member and a proximal end connected to the movable portion, the operated portion including a flange portion extending in a radial direction between the distal end and the proximal end;

a waterproof cover made of elastomer material, the waterproof cover including a first watertight portion in which a through hole is formed, the first watertight portion being in tight contact with an outer circumferential surface of a part of the operated portion between the distal end and the flange portion, a second watertight portion that is in tight contact with an internal surface of the exterior member in a manner of surrounding the opening or in tight contact with a whole inner circumferential surface of the opening in a circumferential direction, and a film-like portion provided between the first watertight portion and the second watertight portion; and a retaining member formed as a member separated from the exterior member, and including an opening portion through which a part of the operated portion closer to the distal end than the flange portion can pass but the flange portion cannot pass, the retaining member having an entire shape formed in a hat shape with a brim, the hat shape having a distal end portion where the opening portion is formed as a top portion, the retaining member being disposed farther inward from the exterior member than the waterproof cover.

2. The waterproof switch device according to claim 1, wherein an outer circumferential portion of the retaining member extending from the opening portion is supported in a sandwiched manner between the body portion of the switch member and the second watertight portion of the waterproof cover.

3. The waterproof switch device according to claim 1, wherein a space is defined between the operated portion and the retaining member such that the switch member can perform a tilt movement with respect to the exterior member of the electronic apparatus.

4. The waterproof switch device according to claim 1, wherein a space is defined between the operated portion and the retaining member such that the switch member can perform a tilt movement in at least eight directions from a neutral position with respect to the exterior member of the electronic apparatus.

* * * * *